US011721272B2

(12) United States Patent
Lee et al.

(10) Patent No.: US 11,721,272 B2
(45) Date of Patent: Aug. 8, 2023

(54) DISPLAY DRIVING INTEGRATED CIRCUIT, DISPLAY DEVICE AND METHOD OF OPERATING SAME

(71) Applicant: SAMSUNG ELECTRONICS CO., LTD., Suwon-si (KR)

(72) Inventors: Jonghyun Lee, Goyang-si (KR); Kyounghwan Kwon, Seoul (KR); Jongoh Lee, Anyang-si (KR); Yuneseok Chung, Suwon-si (KR)

(73) Assignee: SAMSUNG ELECTRONICS CO., LTD.

( * ) Notice: Subject to any disclaimer, the term of this patent is extended or adjusted under 35 U.S.C. 154(b) by 0 days.

(21) Appl. No.: 17/345,269

(22) Filed: Jun. 11, 2021

(65) Prior Publication Data

US 2022/0189389 A1 Jun. 16, 2022

(30) Foreign Application Priority Data

Dec. 11, 2020 (KR) ..... 10-2020-0173649

(51) Int. Cl.

| | |
|---|---|
| ***G09G 3/20*** | (2006.01) |
| ***G09G 5/00*** | (2006.01) |
| ***G09G 3/3208*** | (2016.01) |

(52) U.S. Cl.

CPC ..... *G09G 3/2096* (2013.01); *G09G 3/2044* (2013.01); *G09G 3/3208* (2013.01); *G09G 5/006* (2013.01); *G09G 2320/10* (2013.01); *G09G 2320/103* (2013.01); *G09G 2340/02* (2013.01); *G09G 2360/127* (2013.01); *G09G 2360/128* (2013.01); *G09G 2360/18* (2013.01)

(58) Field of Classification Search

CPC ..... G09G 2320/10; G09G 2320/103

See application file for complete search history.

(56) References Cited

U.S. PATENT DOCUMENTS

| | | | | |
|---|---|---|---|---|
| 5,718,228 | A * | 2/1998 | Hiruta | A61B 5/6843 600/440 |
| 8,766,968 | B2 | 7/2014 | Lee et al. | |
| 9,159,284 | B2 | 10/2015 | Park et al. | |

(Continued)

FOREIGN PATENT DOCUMENTS

| | | | |
|---|---|---|---|
| JP | 4916156 | A | 5/2007 |
| KR | 20160031088 | A | 3/2016 |

*Primary Examiner* — William Boddie
*Assistant Examiner* — Bipin Gyawali
(74) *Attorney, Agent, or Firm* — Fish & Richardson P.C.

(57) ABSTRACT

A display driving integrated circuit (DDIC) driving a display device and including; a host interface configured to receive image data from a host device, an interface monitor configured to generate a mode signal indicating a still image mode or a video mode by detecting whether the image data from the host device is transferred through the host interface, a processing circuit configured to generate processed data by processing the image data, a conversion circuit configured to perform data conversion on the processed data to generate display data driving a display panel, and a path controller configured to store the processed data in a frame buffer and transfer the processed data stored in the frame buffer to the conversion circuit in the still image mode, and further configured to transfer the processed data to the conversion circuit without storing the processed data in the frame buffer in the video mode.

19 Claims, 15 Drawing Sheets

(56) References Cited

U.S. PATENT DOCUMENTS

| | | | | |
|---|---|---|---|---|
| 9,672,792 | B2 | 6/2017 | Choi et al. | |
| 2002/0140685 | A1 | 10/2002 | Yamamoto et al. | |
| 2003/0030607 | A1* | 2/2003 | Kitagawa | G09G 3/2092 345/87 |
| 2005/0080500 | A1* | 4/2005 | Kimura | G11B 20/10527 381/104 |
| 2005/0204313 | A1* | 9/2005 | Enoki | G09G 3/28 348/173 |
| 2007/0024557 | A1* | 2/2007 | Rho | G09G 5/005 345/88 |
| 2010/0149377 | A1* | 6/2010 | Shintani | H04N 23/667 348/222.1 |
| 2012/0154678 | A1* | 6/2012 | Chang | G06F 3/1454 348/E5.009 |
| 2013/0044087 | A1* | 2/2013 | Hsu | G09G 5/003 345/204 |
| 2015/0103081 | A1* | 4/2015 | Bae | G09G 5/18 345/501 |
| 2016/0323620 | A1* | 11/2016 | Kim | H04N 21/4126 |

* cited by examiner

DISPLAY DRIVING INTEGRATED CIRCUIT, DISPLAY DEVICE AND METHOD OF OPERATING SAME

CROSS-REFERENCE TO RELATED APPLICATION

This U.S. non-provisional application claims priority under 35 USC § 119 to Korean Patent Application No. 10-2020-0173649 filed on Dec. 11, 2020 in the Korean Intellectual Property Office, the subject matter of which is hereby incorporated by reference.

BACKGROUND

1. Technical Field

The inventive concept relates generally to semiconductor integrated circuits, and more particularly to display driving integrated circuits (DDIC) associated with display devices, as well as methods of operating a DDIC.

2. Discussion of the Related Art

Contemporary mobile devices may include a display device (e.g., an organic light emitting diode (OLED) display device) requiring an increased memory capacity for processing image data. However, such mobile devices consume significant power due to high speed driving of a frame rate greater than or equal to 120 Hz. In addition, the size of a constituent DDIC may increase due to an increase in the resolution of the display panel.

A DDIC in a mobile device such as a smartphone usually includes an embedded static random access memory (SRAM) as a frame buffer storing image data. A compensation memory may also be used to enhance the quality of a displayed image. However, the size of the compensation memory may increase to address certain problems such as burn-in, hysteresis, etc. Hence, the size and cost of the DDIC may increase given demands for expanded memory capacity upon various internal memory components. In addition, power consumption by the DDIC may increase as the result of increased resolution demands on image data, and additional data processing requirements, etc.

SUMMARY

Embodiments of the inventive concept provide display driving integrated circuits (DDIC), display devices including a DDIC, and methods of operating a DDIC capable of efficiently displaying both still images and video.

DDIC according to embodiments of the inventive concept may efficiently implement a still image mode and a video mode using the interface monitor and the path controller.

DDIC and display devices according to embodiments of the inventive concept may enable reduction in the size and the power consumption of the DDIC by appropriately disposing a frame buffer and a compensation memory.

DDIC and display devices according to embodiments of the inventive concept may enable reduction in the size and the power consumption of the DDIC by disabling one or more DDIC components in accordance with operating mode.

In some embodiments, a display driving integrated circuit (DDIC) includes; a host interface configured to receive image data from a host device, an interface monitor configured to generate a mode signal indicating a still image mode or a video mode by detecting whether the image data from the host device is transferred through the host interface, a processing circuit configured to generate processed data by processing the image data, a conversion circuit configured to perform data conversion on the processed data to generate display data driving a display panel, and a path controller configured to store the processed data in a frame buffer and transfer the processed data stored in the frame buffer to the conversion circuit in the still image mode, and further configured to transfer the processed data to the conversion circuit without storing the processed data in the frame buffer in the video mode.

In some embodiments, a method of operating a display driving integrated circuit (DDIC) includes; generating a mode signal indicating a still image mode or a video mode by detecting whether image data is transferred through a host interface from a host device, processing the image date to generate processed data using a processing circuit, in the still image mode, storing the processed data in a frame buffer and generating display data to drive a display panel in response to the processed data stored in the frame buffer, and in the video mode, generating the display data in response to the processed data provided from the processing circuit without storing the processed data in the frame buffer.

In some embodiments, a display device includes; a display panel and a display driving integrated circuit (DDIC) configured to drive the display panel. Here, the DDIC may include; a host interface configured to receive image data from a host device, an interface monitor configured to generate a mode signal indicating a still image mode or a video mode by detecting whether the image data from the host device is transferred through the host interface, a processing circuit configured to generate processed data by processing the image data, a conversion circuit configured to perform data conversion on the processed data to generate display data driving a display panel and a path controller configured to store the processed data in a frame buffer and transfer the processed data stored in the frame buffer to the conversion circuit in the still image mode, and further configured to transfer the processed data to the conversion circuit without storing the processed data in the frame buffer in the video mode.

BRIEF DESCRIPTION OF THE DRAWINGS

Embodiments of the inventive concept may be more clearly understood upon consideration of the following detailed description together with the accompanying drawings in which.

DETAILED DESCRIPTION

Throughout the written description and drawings, like reference numbers and labels are used to denote like or similar elements, components, and/or features.

Figure 1:
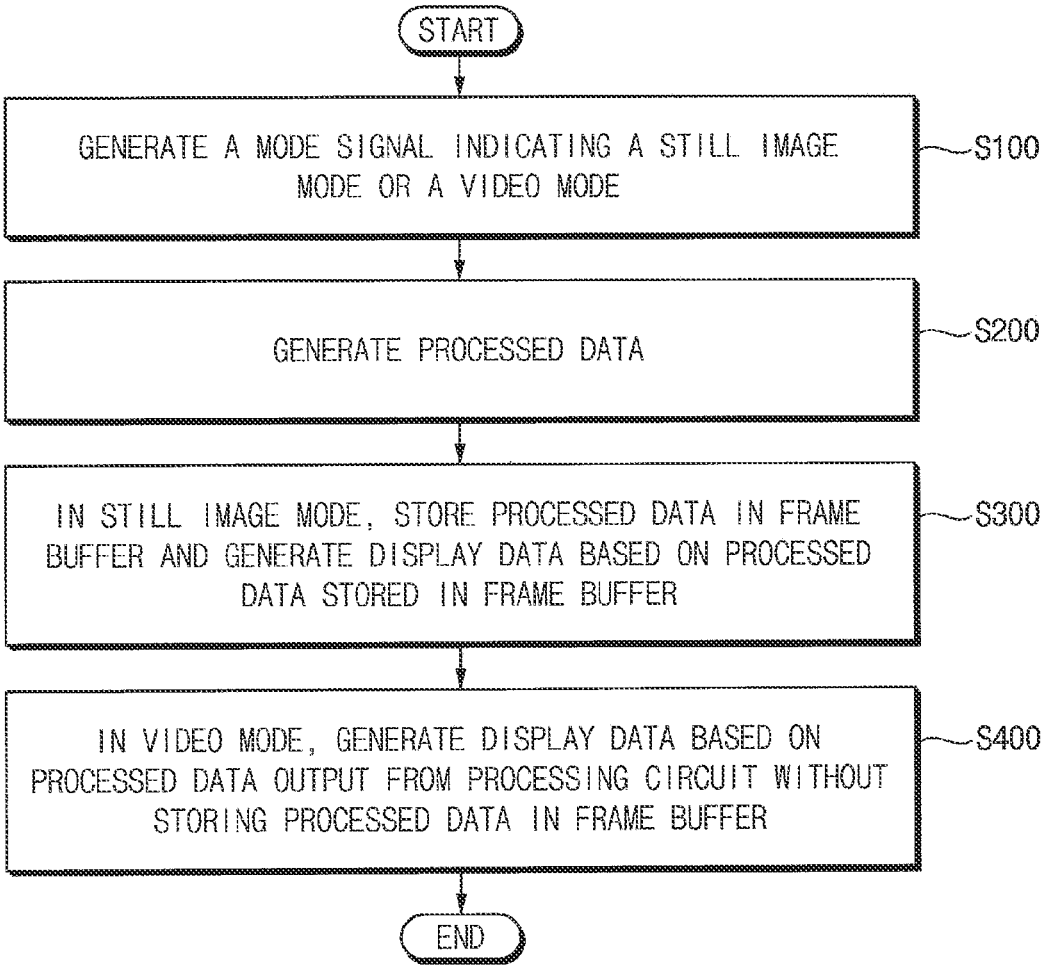
FIG. 1 is a flow chart illustrating in one example a method of operating a display driving integrated circuit (DDIC) according to embodiments of the inventive concept.

FIG. 1 is a flow chart illustrating a method of operating a display driving integrated circuit (DDIC) according to embodiments of the inventive concept.

Referring to FIG. 1, a mode signal may be generated that indicates a still image mode or a video mode (S100). In some embodiments, the mode signal may be generated by detecting whether image data is transferred from a host device through a host interface. Examples of generating the mode signal will be described in some additional detail hereafter with reference to FIGS. 3, 10 and 11.

Processed data may be generated (S200). This may be accomplished in some embodiments by processing image data using a processing circuit. An exemplary processing circuit capable of performing image processing which will be described in some additional detail hereafter with reference to FIG. 5.

In the still image mode, the processed data may be stored in a frame buffer and display data (e.g., display data used to drive a display panel) may be generated based on the processed data stored in the frame buffer (S300). Here, the processing circuit may be disabled in the still image mode in response to the mode signal, thereby reducing power consumption by the DDIC.

In the video mode, the display data may be generated based on the processed data provided by the processing circuit without storing the processed data in the frame buffer (S400). Here, DDIC power consumption may be reduced in the video mode by generating the display data using a data flow that skips (e.g., does not pass through) the frame buffer.

As will be described hereafter in some additional detail with reference to FIGS. 6, 7 and 8, the frame buffer may be internal to the DDIC or external to the DDIC. In addition, the compensation memory used to store data during the processing of the image data may be internal to the DDIC or external to the DDIC.

Using the foregoing method, DDIC according to embodiments of the inventive concept may efficiently operate in the still image mode or the video mode using an interface monitor and a path controller. In addition, DDIC and display devices according to embodiments of the inventive concept may have a reduced size and operate with reduced power consumption by appropriate arrangement of the frame buffer and the compensation memory, thereby enabling selective disablement of DDIC component(s) in response to operating mode.

Figure 2:
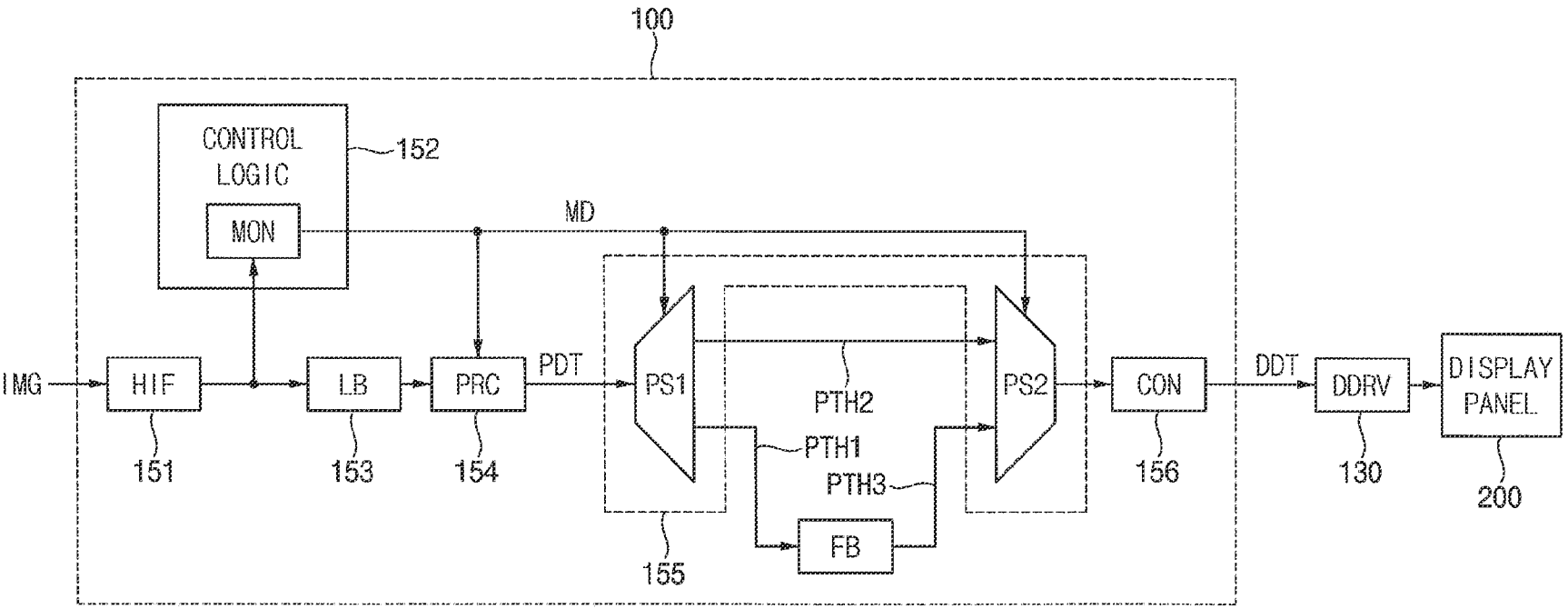
FIGS. 2, 4, 6, 7, 8 and 9 are respective block diagrams illustrating DDIC according to various embodiments of the inventive concept.

FIG. 2 is a block diagram illustrating a DDIC 100 according to embodiments of the inventive concept.

Referring to FIG. 2, the DDIC 100 may include a host interface HIF 151, control logic 152, an interface monitor MON, a line buffer LB 153, a processing circuit PRC 154, a path controller 155, a frame buffer FB and a conversion circuit CON 156. A data driver DDRV 130 and a display panel 200 are also illustrated in FIG. 2 in relation to the DDIC 100. However, in some embodiments, the data driver 130 may be internal to the DDIC 100.

Figure 13:
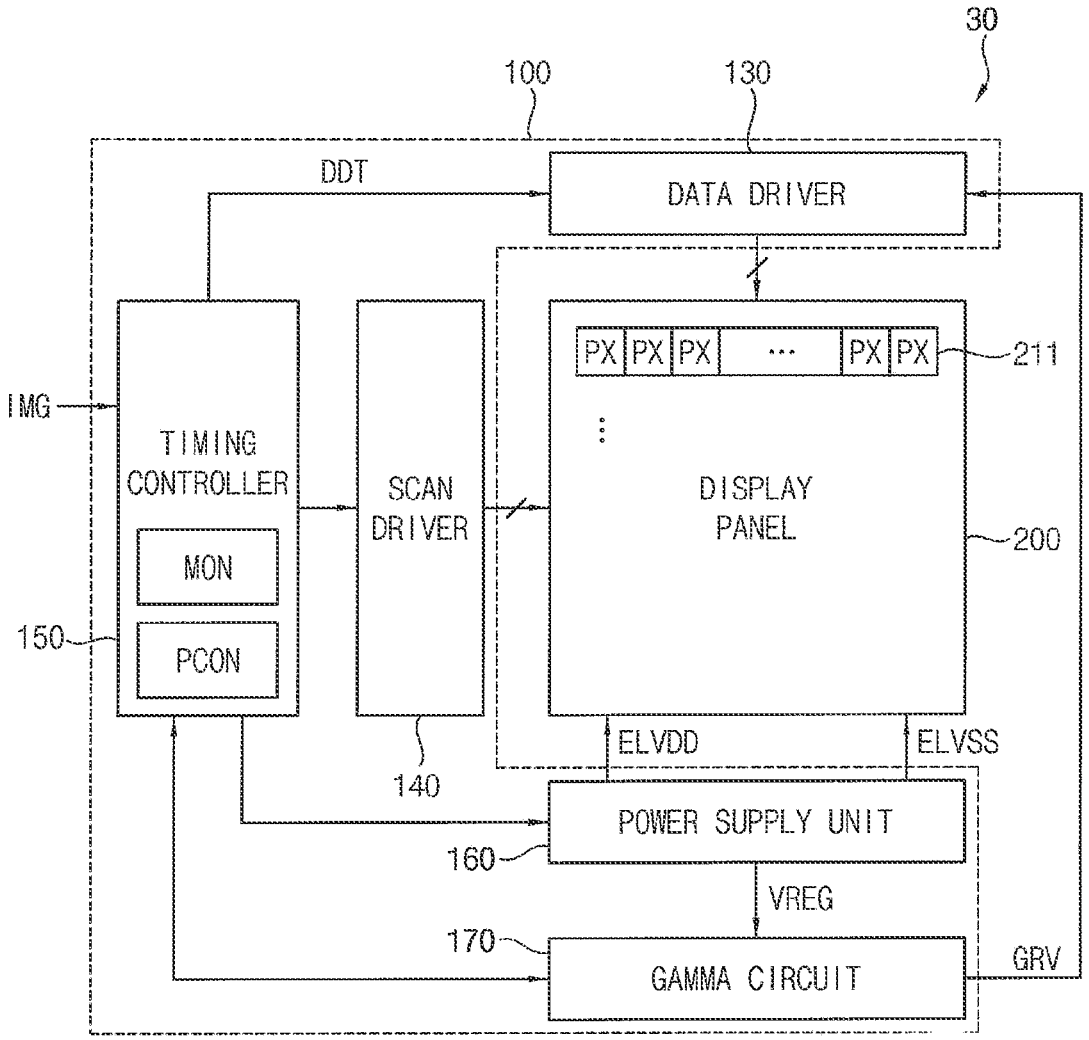
FIG. 13 is a block diagram further illustrating in one example the electroluminescent display device 30 of FIG. 11.

As described hereafter with reference to FIG. 13, in some embodiments, the DDIC 100 may further include a scan driver, a power supply, a gamma circuit, etc. In some embodiments like the one illustrated in FIG. 2, the frame buffer FB may be internal to the DDIC 100. However, in other embodiments, the frame buffer FB may be external to the DDIC 100.

The host interface 151 may receive image data IMG from a host device (not shown in FIG. 2). Here, it is assumed that the host interface 151 operates in a manner consistent with published technical standards associated with (e.g.) the Mobile Industry Processor Interface (MIPI), the Display Port (DP) and/or the embedded Display Port (eDP).

The control logic 152 may control the overall operation of the host interface 151, the interface monitor MON, the line buffer 153, the processing circuit 154, the path controller 155, the frame buffer FB and the conversion circuit 156 included in the DDIC 100.

The interface monitor MON may be connected to the host interface 151. The interface monitor MON may generate a mode signal MD indicating a still image mode or a video mode. In some embodiments, the selection between the still image mode and the video mode may be made, for example, by detecting whether image data IMG is transferred from the host device through the host interface 151. In some embodiments like the one illustrated in FIG. 2, the interface monitor MON may be implemented using the control logic 152. Alternately, the interface monitor MON may be separately implemented in hardware external to the control logic 152.

As the bandwidth of data transfers associated with a display field have increased, high-speed data transfers are required. As a result, a low voltage differential signaling (LVDS) scheme may be used in relation to the display field. Because the LVDS scheme is used, data bandwidth may be increased, power consumption may be reduced, manufacturing costs may be reduced, and electro-magnetic interference (EMI) may also be reduced.

The image display provided by the display device may include video having a variable and high frame rate, or a still image having a fixed and low frame rate. In case of the still image, a panel self-refresh (PSR) scheme may be used, thereby obviating the need to repeatedly transfer the image data. However, if both video data and still image data must be transferred to a DDIC using unidirectional communication such as the LVDS (as is conventional) reduction in power consumption may be limited.

Accordingly, DDIC consistent with embodiments of the inventive concept may efficiently select (or not) the use of unidirectional communication such as the LVDS by distinguishing operation in the video mode or in the still image mode. In some embodiments, this distinguishing determination may be made using the interface monitor MON. That is, the DDIC 100 of FIG. 2 does not require synchronization with the host device during mode conversion between the video mode and the still image mode.

In some embodiments, as will be described hereafter in some additional detail with reference to FIG. 3, the interface monitor MON may generate the mode signal MD by monitoring whether image data IMG is transferred from the host device, through the host interface 151 within a defined standby time tSB.

Figure 11:
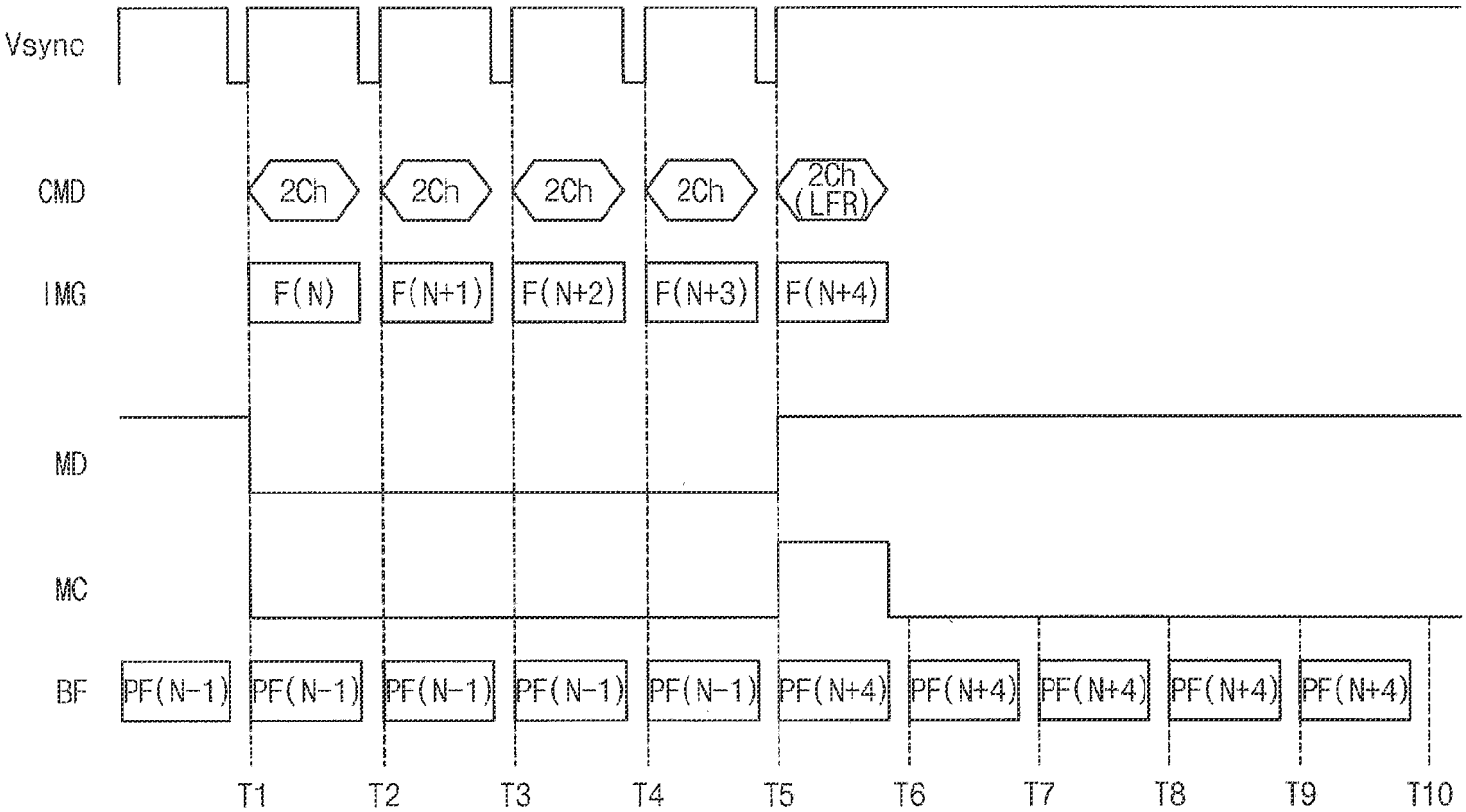

In some embodiments like the embodiment described hereafter in relation to FIG. 11, the host device may provide to the DDIC 100, certain mode conversion information indicating whether a data frame included in the image data indicates the still image mode, and in response, the interface monitor MON may generate the mode signal MD based on the mode conversion information.

The line buffer 153 may be disposed between the host interface 151 and the processing circuit 154. The line buffer 153 may buffer image data IMG and output (or provide) buffered image data IMG by units of line.

The processing circuit 154 may generate processed data PDT by processing image data IMG. One approach to the image processing performed by the processing circuit 154 will be described hereafter in relation to the block diagram of FIG. 5.

The path controller 155 may be used to control a data transfer path in response to the mode signal MD. The path controller 155 may store the processed data PDT in the frame buffer FB and transfer the processed data PDT stored in the frame buffer FB to the conversion circuit 156 when the mode signal MD indicates the still image mode. Alternately, the path controller 155 may transfer the processed data PDT to the conversion circuit 156 without storing the processed data PDT in the frame buffer FB when the mode signal MD indicates the video mode.

In some embodiments, the path controller 155 may include a first path selector PS1 and a second path selector PS2.

The first path selector PS1 may output the processed data PDT to a first path PTH1 connected to the frame buffer FB when the mode signal MD indicates the still image mode. Alternately, the first path selector PS1 may output the processed data PDT to a second path PTH2 that is not connected to the frame buffer FB when the mode signal MD indicates the video mode.

The second path selector PS2 may output the processed data PDT transferred through a third path PTH3 connected to the frame buffer FB to the conversion circuit 156 when the mode signal MD indicates the still image mode. Alternately, the second path selector PS2 may output the processed data PDT transferred through the second path PTH2 to the conversion circuit 156 when the mode signal MD indicates the video mode.

Using the path controller 155, the processed data PDT may be stored in the frame buffer FB and the display data DDT may be generated based on the processed data PDT stored in the frame buffer FB in the still image mode, whereas the display data DDT may be generated based on the processed data PDT without passing through the frame buffer FB in the video mode.

The processing circuit 154 may be disabled in the still image mode because the display data DDT may be generated based on the processed data PDT stored in the frame buffer FB. In addition, the host device need not transfer image data IMG to the DDIC 100 in the still image mode. As such, the power consumption of the DDIC 100 and the display device including the DDIC 100 may be reduced by disabling the processing circuit 154 and decreasing the amount of data transferred from the host device.

The conversion circuit 156 may perform data conversion with respect to the processed data PDT to generate display data DDT to drive the display panel 200. The processing circuit 154 may perform data processing such that the same output is provided with respect to the same input. Alternately, the conversion circuit 156 may perform data conversion such that the different output is provided with respect to the same input by applying modification to the input. In some embodiments, the conversion circuit 156 may perform dithering with respect to the processed data PDT to generate the display data DDT.

The dithering in image processing indicates a scheme to represent a required color using difference colors when a computer program cannot represent the required color. The different colors may be mixed by disposing the different color to adjacent dots (e.g., pixels) as similar to pointillism to represent the required color when seen from a distance. The conversion circuit 156 may adopt an average dithering scheme, a random dithering scheme, a pattern dithering scheme, an ordered dithering scheme, etc. For example, when an image of higher resolution is converted to an image of lower resolution, two or more different colors may be mixed in a boundary region of the different colors.

The data driver DDRV may be used to drive the display panel 200 to display an image based on the display data DDT. Here, an exemplary configuration and operation of a display device including the data driver DDRV and the display panel 200 will be described hereafter in some additional detail with reference to FIGS. 12 and 13.

With the foregoing configuration, the DDIC 100 of FIG. 2 may efficiently implement the still image mode and the video mode using the interface monitor MON and the path controller 155.

Figure 3:
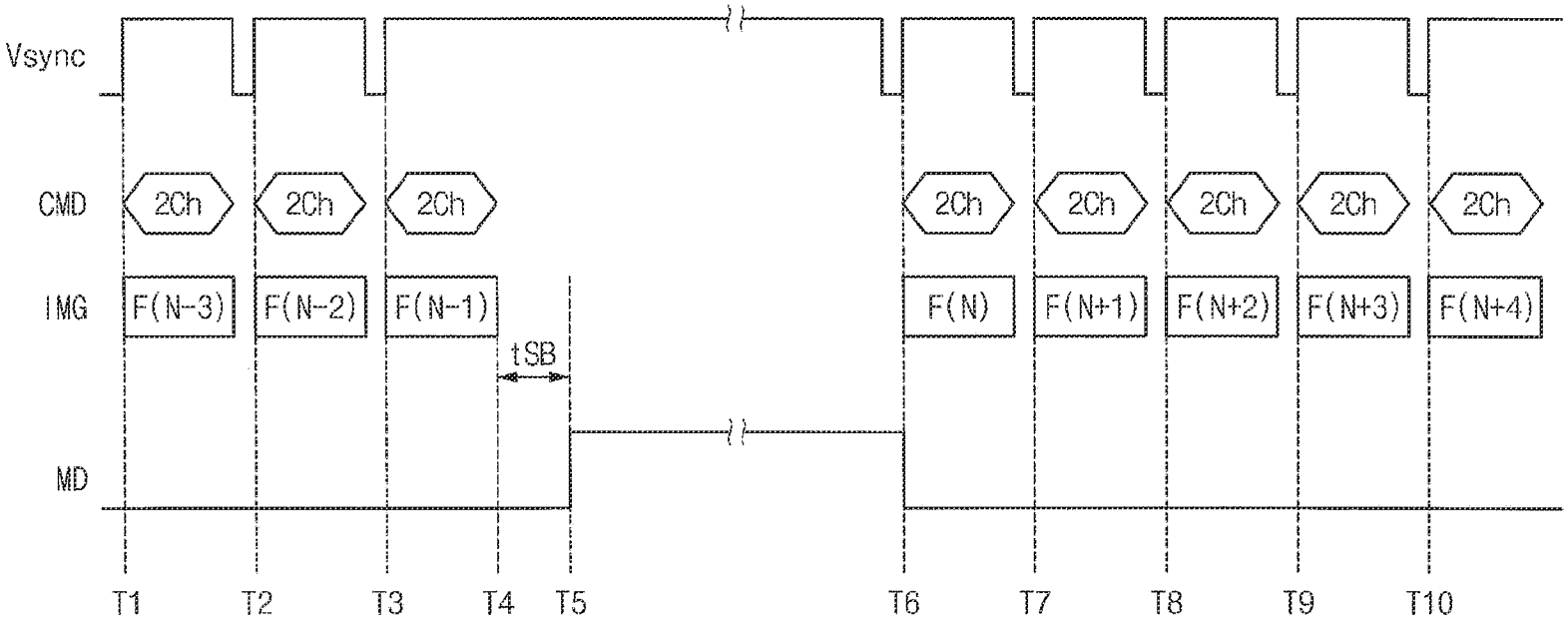
FIG. 3 is a timing diagram further illustrating the operation of a DDIC according to embodiments of the inventive concept.

FIG. 3 is a timing diagram further illustrating in one example an approach to the generating of the mode signal in a DDIC according to embodiments of the inventive concept.

Referring to FIGS. 1, 2 and 3, the host device may transfer commands CMD and image data IMG to a DDIC. Here, the respective commands CMD are shown as being temporally distinct from image data IMG for convenience of illustration. However, in other embodiments, the commands and image data IMG may be combined using a defined packet format, the resulting packets may be transferred from the host device and the DDIC 100. Further, the embodiment illustrated in FIG. assumes, as an example, write_memory_start commands 2Ch according to the MIPI standard, but embodiments of the inventive concept are not limited to a particular standard and a particular command.

Hence, it is assumed in the illustrated example of FIG. 3 that the host device transfers data frames F(i) to the DDIC 100 synchronously with a vertical synchronization signal Vsync, where 'i' is an integer indicating a frame index. FIG. 3 illustrates an example of the data frames F(N−3)~F(N+4) in synchronization with activation times T1~T3 and T6~T10 transferred from the host device to the DDIC 100.

Consistent with the foregoing, the interface monitor MON may be connected to the host interface 151, and generate the mode signal MD indicating the still image mode or the video mode by detecting whether image data IMG is transferred through the host interface 151 from the host device.

The mode signal MD may a one-bit signal and the still image mode and the video mode may be indicated by the logic level of the mode signal MD. For example, as illustrated in FIG. 3, the logic low level of the mode signal MD may indicate the video mode and the logic high level of the mode signal MD may indicate the still image mode, but example embodiments are not limited to a particular definition of the logic level.

In some embodiments, the interface monitor MON of FIG. 2 may be used the mode signal MD by monitoring whether image data IMG is transferred through the host interface 151 from the host device within a standby time tSB. That is, the interface monitor MON may transition the mode signal MD from the logic low level to the logic high level at the time T4 to convert the operating mode from the video mode to the still image mode if image data IMG is not transferred from the host device within the standby time tSB from the time T4 when the transfer of the last data frame F(N−1) of the video mode is completed.

As such, DDIC according to embodiments of the inventive concept may efficiently control the mode conversion between the video mode and the still image mode by monitoring the transfer of image data IMG using the interface monitor MON.

Figure 4:
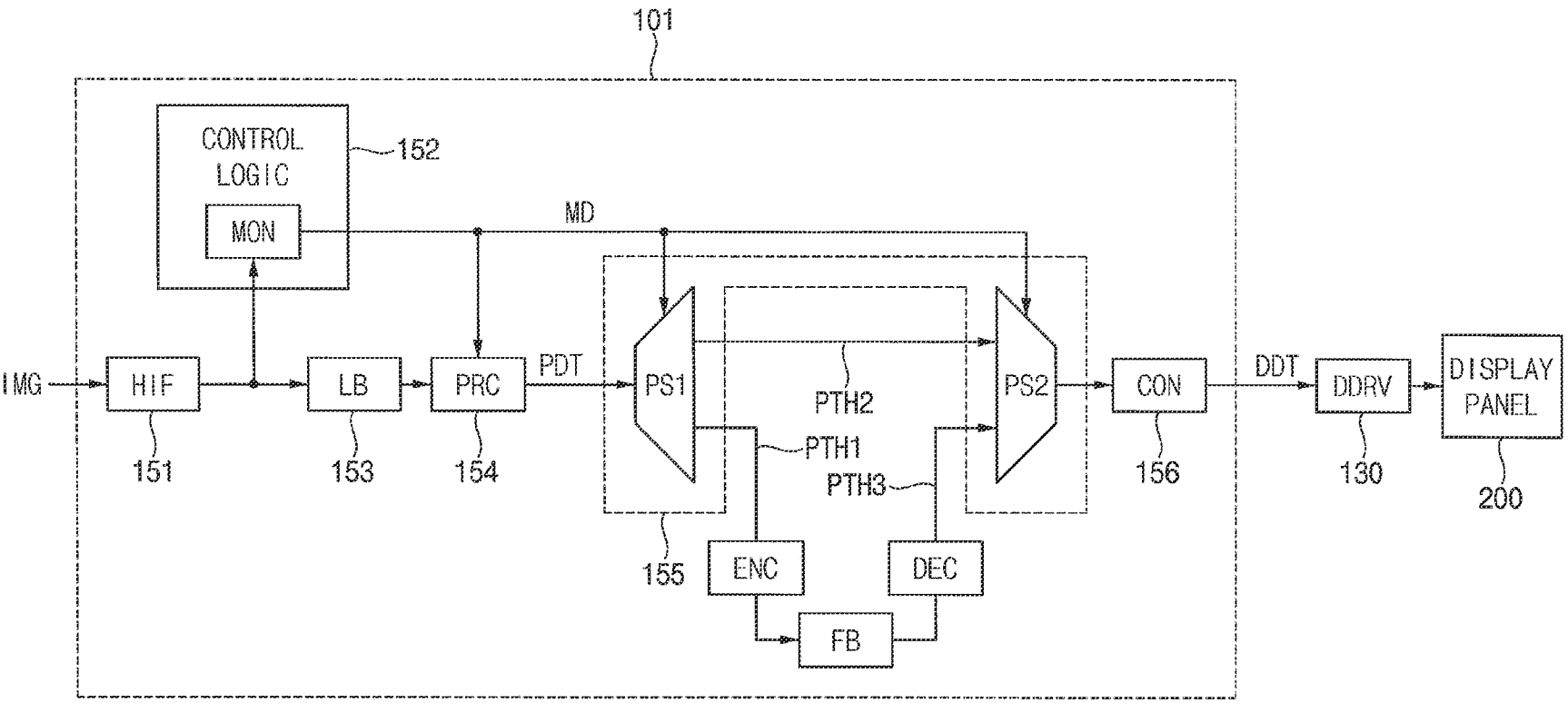

FIG. 4 is a block diagram illustrating a DDIC 101 according to embodiments of the inventive concept.

Referring to FIG. 4, the DDIC 101 may be substantially the same as the DDIC 100 of FIG. 2, except for the addition of an encoder ENC and a decoder DEC.

Here, the encoder ENC may be disposed between the processing circuit 154 and the frame buffer FB, and may be used to compress the processed data PDT received from the processing circuit 154 and store the compressed data in the frame buffer FB. The decoder DEC may be disposed between the frame buffer FB and the conversion circuit 156, and may be used to decompress the compressed data retrieved from the frame buffer FB to transfer the processed data PDT to the conversion circuit 156.

As described with reference to FIG. 2, the path controller 155 may include the first path selector PS1 and the second path selector PS2 to control the data transfer path between the processing circuit 154, the frame buffer FB and the conversion circuit 156.

The first path selector PS1 may output the processed data PDT to the first path PTH1 or the second path PTH2 based on the mode signal MD. The second path selector PS2 may transfer the processed data PDT transferred through the second path PTH2 or the third path PTH3 to the conversion circuit 156 based on the mode signal MD. In this case, the encoder ENC may be disposed on the first path PTH1 and the decoder DEC may be disposed on the third path PTH3.

With the foregoing configuration, the size of the frame buffer FB may be reduced due to the inclusion of the encoder ENC and the decoder DEC. However, data loss may increase as the compression rate of the encoder ENC is increased. As will be described hereafter in some additional detail with reference to FIG. 5, the processing circuit 154 may perform sub pixel rendering (SPR), and the amount of the processed data PDT may be reduced by the SPR. As such, data loss may be reduced by arranging the frame buffer FB behind (or after) the processing circuit 154 to compress the processed data PDT of the reduced amount due to the SPR in comparison with compressing image data IMG itself with the same compression rate.

Figure 5:
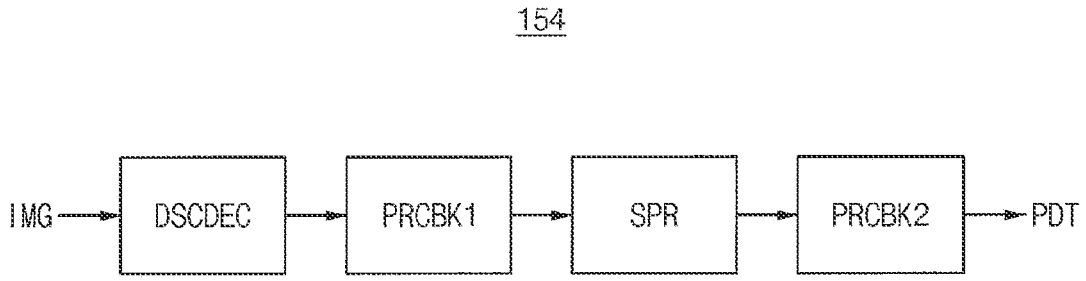
FIG. 5 is a block diagram generally illustrating a processing circuit that may be included in a DDIC according to embodiments of the inventive concept.

FIG. 5 is a block diagram illustrating in one example the processing circuit 154 of FIGS. 2 and 4 according to embodiments of the inventive concept.

Referring to FIG. 5, the processing circuit 154 may include a display stream compression (DSC) decoder DSCDEC, a first processing unit PRCBK1, a sub pixel rendering unit SPR and a second processing unit PRCBK2.

A DDIC consistent with embodiments of the inventive concept may support data transfer using the DSC decoder DSCDEC, such that the host device may transfer compressed image data IMG Further, the DSC decoder DSCDEC may decompress the compressed image data IMG to essentially restore the processed image data IMG. However, in some embodiments, the SDC decoder DSCDEC may be omitted.

The first processing unit PRCBK1, the sub pixel rendering unit SPR and the second processing unit PRCBK2 may form a single pipeline circuit. For example, the first processing unit PRCBK1 may perform one or more functions such as scaling, Always on Display (AoD), mobile digital natural image engine (mDNIe), rounding, etc., and the second processing unit PRCBK2 may perform functions of automatic current limit (ACL), brightness control (BC), IR drop compensation (IRC), pixel optical compensation (POC), etc.

The sub pixel rendering unit SPR may convert a data format of the data output from the first processing unit PRCBK1. For example, the sub pixel rendering unit SPR may convert image data IMG of an RFB format to data of a RG/BG format and provide the data of the RG/BG format to the second processing unit PRCBK2.

The sub pixel rendering unit SPR may convert six color pixels in two RGB clusters to four color pixels in a single RG/BG cluster. If each color pixel is eight bits, the sub pixel rendering unit SPR may convert the data of 8*6=48 bits to the data of 8*4=32 bits to reduce the amount of data.

In this regard, the processing circuit 154 may require a compensation memory to store intermediate data generated during data processing. However, the memory capacity of the compensation memory may expand due to the increasing breadth and sophistication of the image processing operations performed by the processing circuit 154. Thus, when the compensation memory is embedded in the DDIC 100, the size of the DDIC increases and design margin(s) for the DDIC as well as a display system including the DDIC may be degraded.

Figure 6:
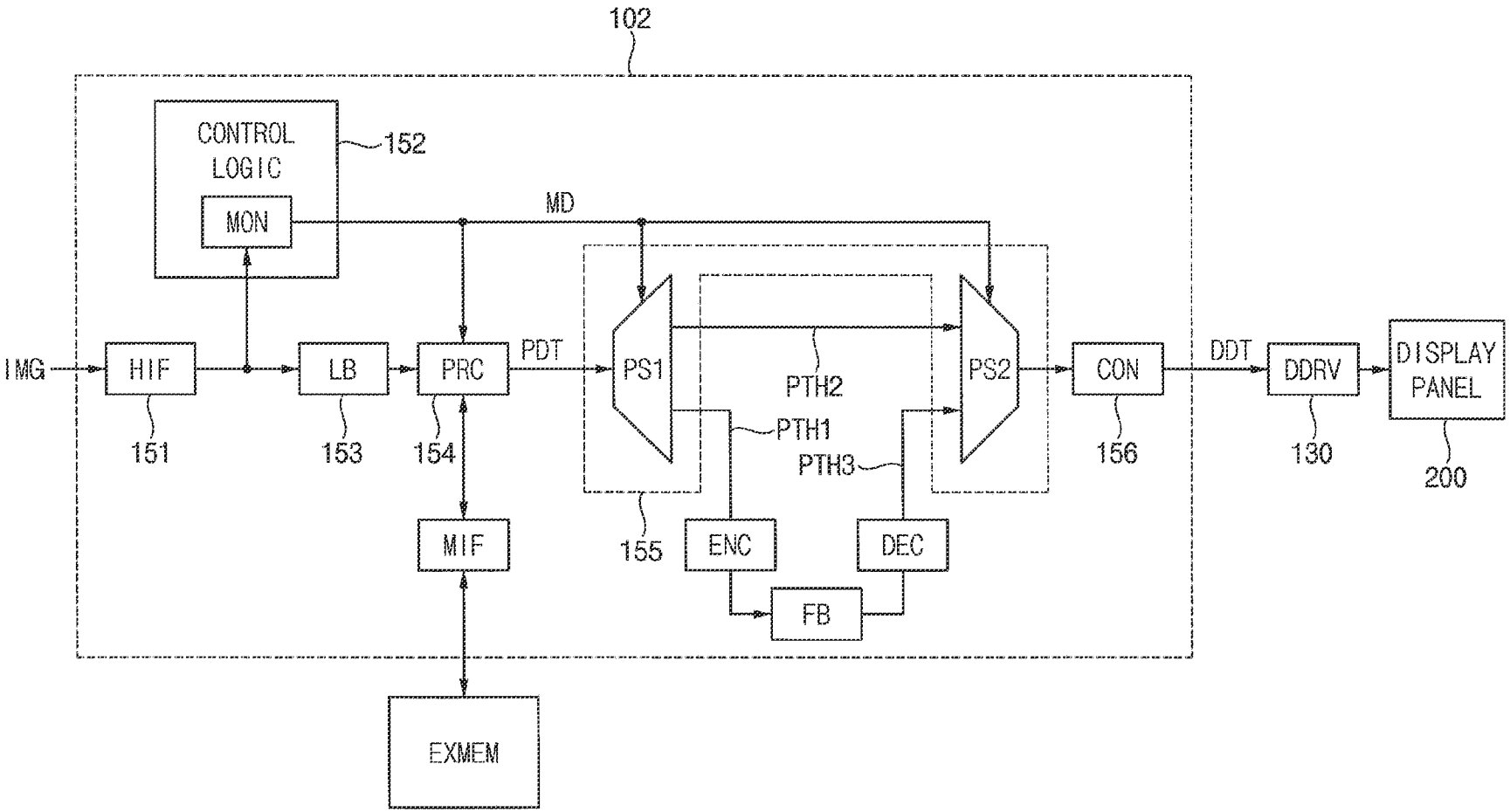
Figure 7:
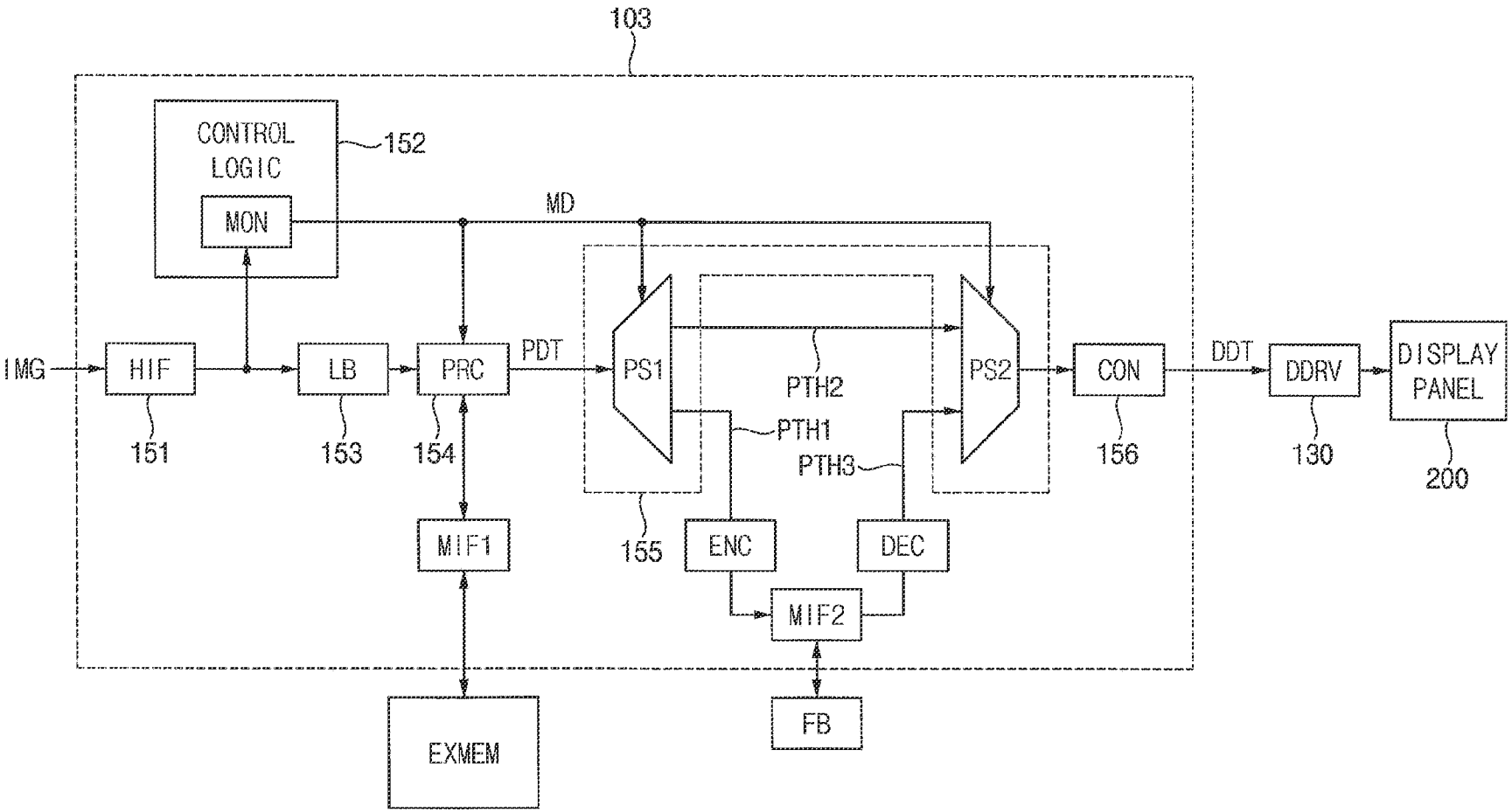
Figure 8:
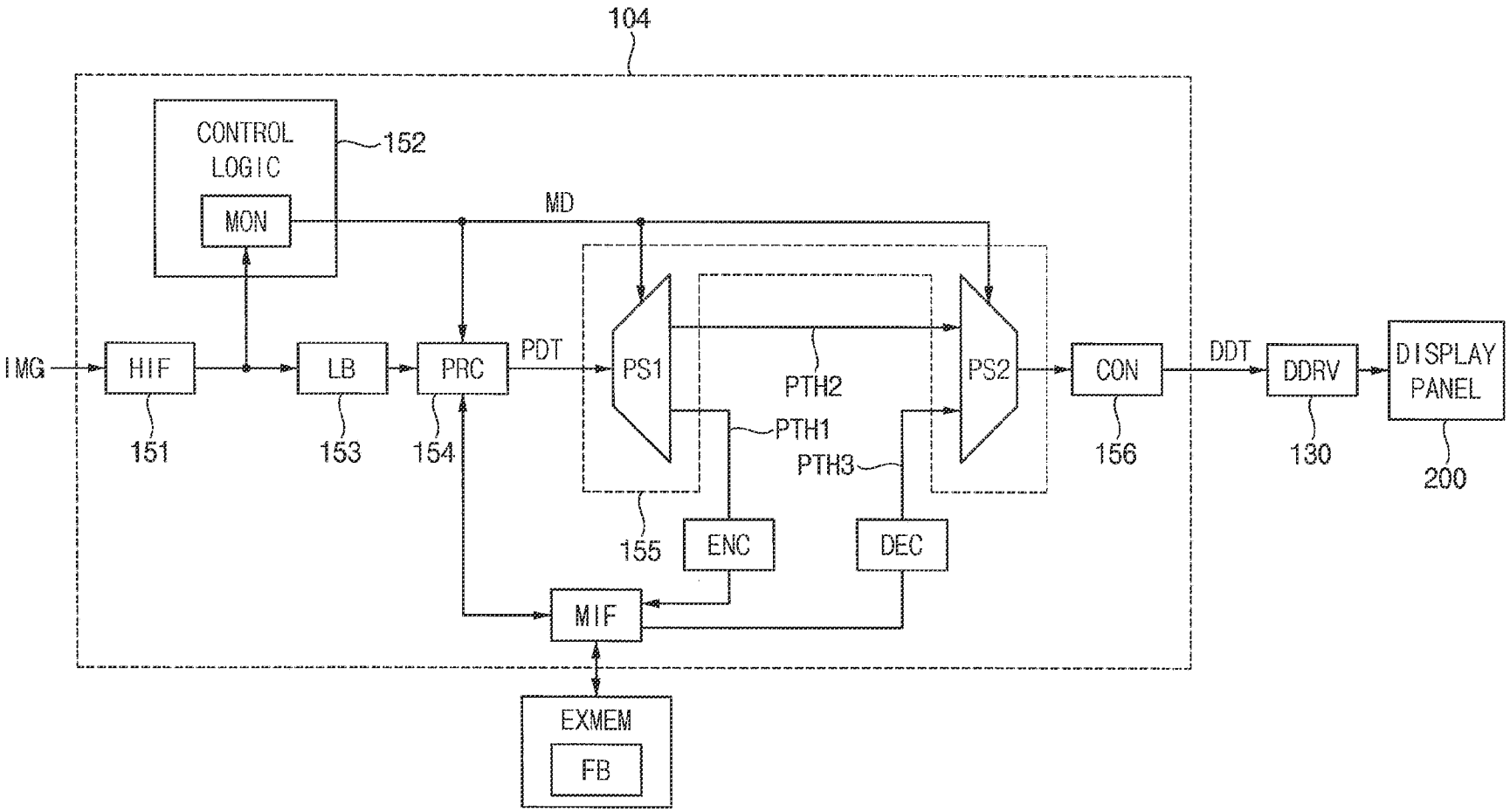

FIGS. 6, 7 and 8 are respective block diagrams variously illustrating DDIC 102, 103 and 104 according to embodiments of the inventive concept.

DDICs 102, 103 and 104 of FIGS. 6, 7 and 8 are substantially the same as the DDIC 101 of FIG. 4, except for the provision and arrangement(s) of the compensation memory and the frame buffer FB. Each of the DDICs 102, 103 and 104 of FIGS. 6, 7 and 8 may be implemented as a single semiconductor chip (e.g., a single package distinct from other components). The semiconductor chip may communicate with one or more external device(s) through various contacts such as pads, solder balls, etc., provided on the surface(s) of the package.

Referring to FIG. 6, the frame buffer FB may be included in the single semiconductor chip providing the DDIC 102. Here, the DDIC 102 may further include a memory interface MIF connected to the processing circuit 154 and the processed data PDT may be transferred through the memory interface MIF between the DDIC 102 and an external memory EXMEM external to the single semiconductor chip providing the DDIC 102. The external memory EXMEM may be used as the compensation memory.

Referring to FIG. 7, both of the compensation memory EXMEM and the frame buffer FB may be external to a single semiconductor chip providing the DDIC 103. The DDIC 103 may further include a first memory interface MIF1 connected to the processing circuit 154 and a second memory interface MIF2 connected to the path controller 155.

The DDIC 103 may store data associated with processing of the processing circuit 154 in the compensation memory EXMEM through the first memory interface MIF1. In addition, the DDIC 103 may store the processed data PDT in the frame buffer FB through the second memory interface MIF2.

Figure 9:
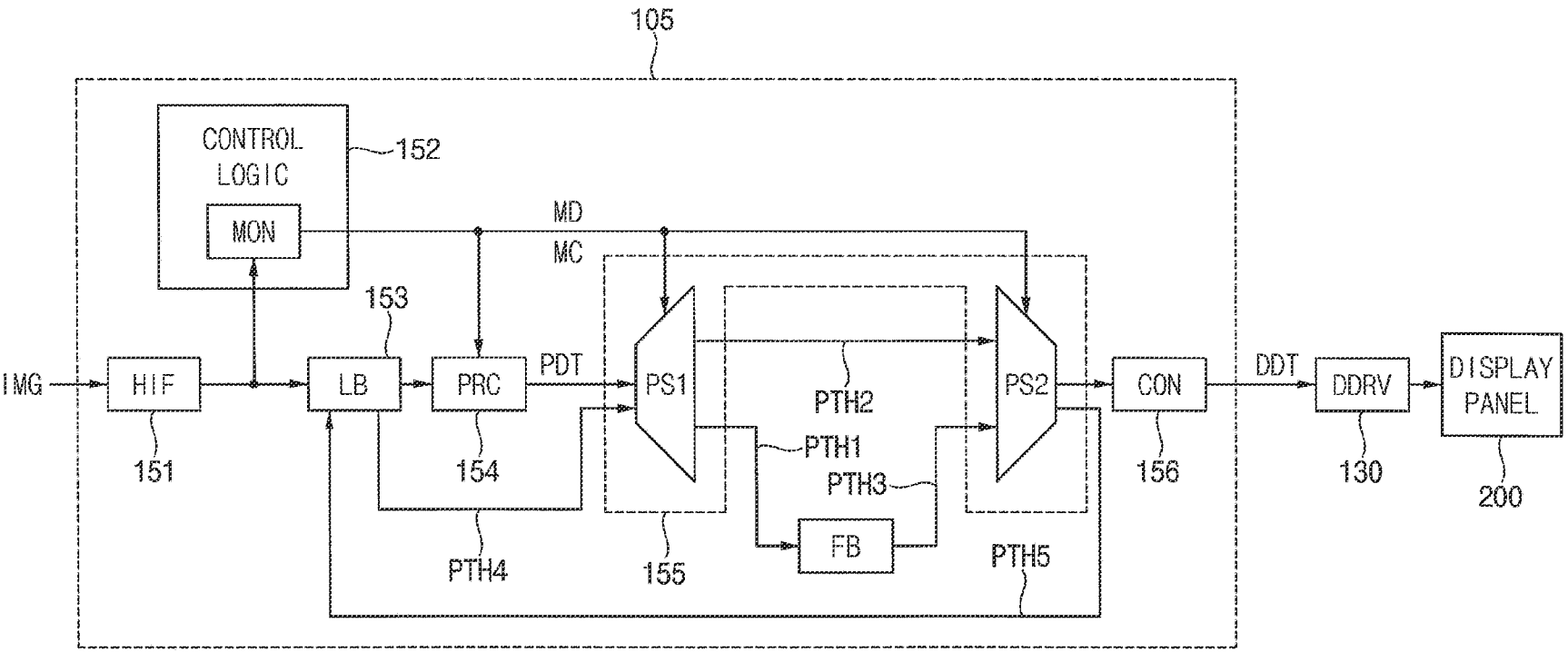
Figure 10:
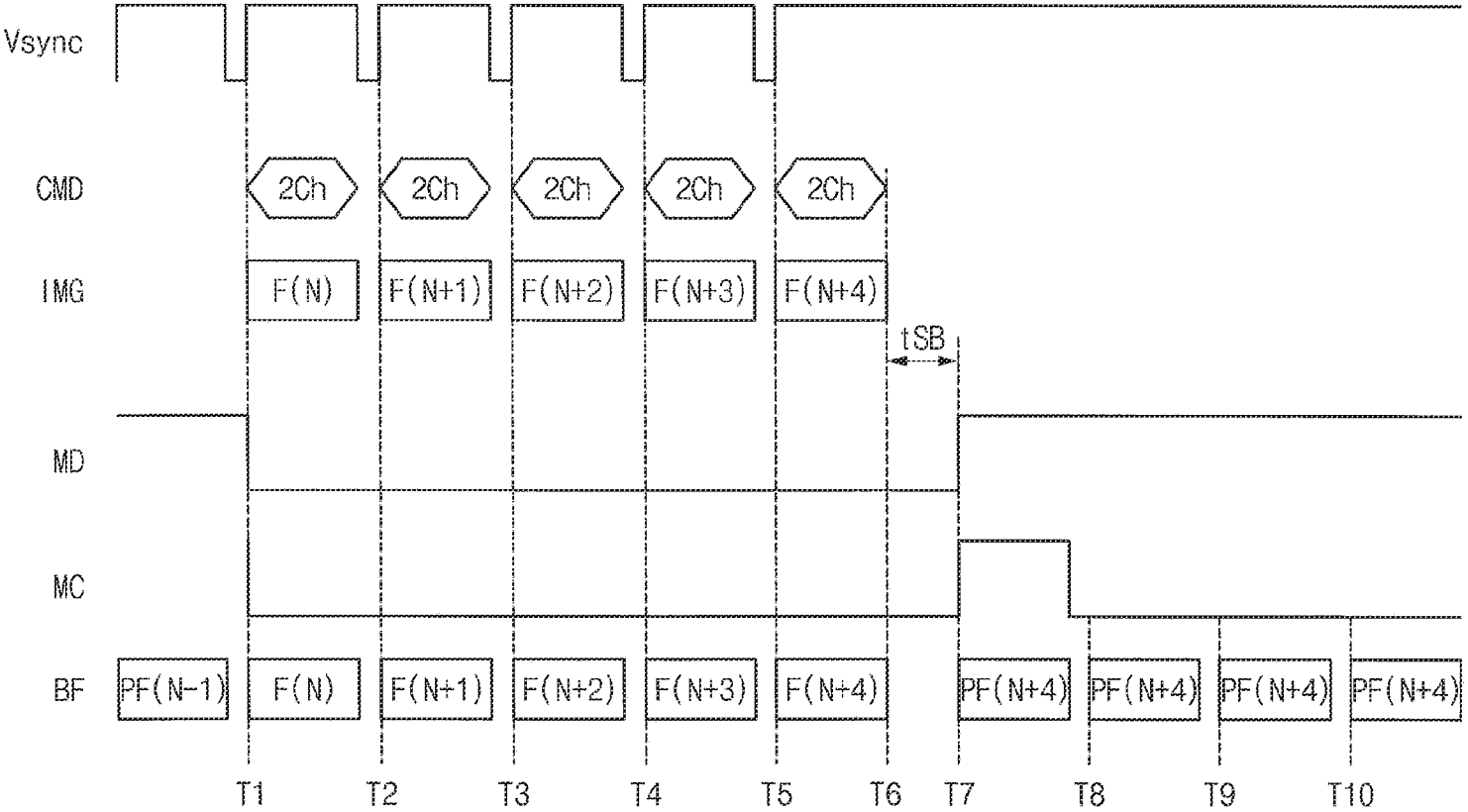
FIGS. 10 and 11 are respective timing diagrams further illustrating the operation of the DDIC of FIG. 9.

According to example embodiments like those described in relation to FIGS. 9, 10 and 11, the DDIC 103 of FIG. 7 may store image data IMG in the frame buffer FB through the second memory interface MIF in the video mode.

Referring to FIG. 8, the external memory EXMEM may be used to implement both the compensation memory and the frame buffer FB external to the single semiconductor chip providing the DDIC 104. The DDIC 104 may further include a memory interface MIF connected to the processing circuit 154 and the path controller 155 to exchange, with the external memory EXMEM, the processed data PDT and the data associated with processing of the processing circuit 154.

As such, the DDIC and the display device according to example embodiments may reduce the size and the power consumption of the DDIC by appropriately disposing the frame buffer and the compensation memory.

FIG. 9 is a block diagram illustrating DDIC 105 according to embodiments of the inventive concept.

Referring to FIG. 9, the DDIC 105 may again include the host interface HIF 151, control logic 152, the interface monitor MON, the line buffer LB 153, the processing circuit PRC 154, the path controller 155, the frame buffer FB and the conversion circuit CON 156. Here again, in some embodiments, the data driver 130 may be included in the DDIC 105. As will be described hereafter in some additional detail with reference to FIG. 13, the DDIC 105 may further include a scan driver, a power supply, a gamma circuit, etc. Here, the frame buffer FB may internal to the DDIC 105 as described in relation to FIG. 2, or the frame buffer FB may external to the DDIC 105 as described in relation to FIGS. 7 and 8.

The host interface 151 may receive image data IMG from the host device. The host interface 151 may be implemented to satisfy standards such as Mobile Industry Processor Interface (MIPI), Display Port (DP), embedded Display Port (eDP), etc.

The control logic 152 may control overall operations of the host interface 151, the interface monitor MON, the line buffer 153, the processing circuit 154, the path controller 155, the frame buffer FB and the conversion circuit 156 included in the DDIC 105.

The interface monitor MON may be connected to the host interface 151. The interface monitor MON may generate the mode signal MD indicating either the still image mode or the video mode by detecting whether image data IMG is transferred through the host interface 151 from the host device. In some embodiments, the interface monitor MON may implemented in the control logic 152. Alternately, the interface monitor MON may be separately implemented in hardware distinct from the control logic 152.

The DDIC 105 may be efficiently applied to the unidirectional communication such as LVDS by distinguishing use of the video mode verses use of the still image mode using the interface monitor MON. That is, the DDIC 105 does not require synchronization with the host device to perform mode conversion between the video mode and the still image mode.

In some embodiments lie the one described with reference to FIG. 3, the interface monitor MON may generate the mode signal MD by monitoring whether image data IMG is transferred through the host interface 151 from the host device within the standby time tSB. In addition, as will be described hereafter with reference to FIG. 10, the interface monitor MON may further generate a mode conversion signal MC indicating mode conversion between the video mode and the still image mode.

In some embodiments, as will be described hereafter with reference to FIG. 11, the interface monitor MON may receive from the host device, mode conversion information indicating that a data frame included in the image data is a last data frame of the video mode, and the interface monitor MON may generate the mode signal MD and the mode conversion signal MC based on the mode conversion information.

The line buffer 153 may be disposed between the host interface 151 and the processing circuit 154. The line buffer 153 may buffer image data IMG and output buffered image data IMG by units of line.

The processing circuit 154 may generate processed data PDT by processing image data IMG. The image processing performed by the processing circuit 154 are the same as described with reference to FIG. 5.

The path controller 155 may control a data transfer path based on the mode signal MD. The path controller 155 may store the processed data PDT in the frame buffer FB and transfer the processed data PDT stored in the frame buffer FB to the conversion circuit 156 when the mode signal MD indicates the still image mode. Alternately, the path controller 155 may transfer the processed data PDT to the conversion circuit 156 without storing the processed data PDT in the frame buffer FB when the mode signal MD indicates the video mode.

In some embodiments, the path controller 155 may include a first path selector PS1 and a second path selector PS2.

The first path selector PS1 may output the processed data PDT to a first path PTH1 connected to the frame buffer FB when the mode signal MD indicates the still image mode. Alternately, the first path selector PS1 may output the processed data PDT to a second path PTH2 that is not connected to the frame buffer FB when the mode signal MD indicates the video mode.

The second path selector PS2 may output the processed data PDT transferred through a third path PTH3 connected to the frame buffer FB to the conversion circuit 156 when the mode signal MD indicates the still image mode. Alternately, the second path selector PS2 may output the processed data PDT transferred through the second path PTH2 to the conversion circuit 156 when the mode signal MD indicates the video mode.

Using the path controller 155, the processed data PDT may be stored in the frame buffer FB and the display data DDT may be generated based on the processed data PDT stored in the frame buffer FB in the still image mode whereas the display data DDT may be generated based on the processed data PDT without passing through the frame buffer FB in the video mode.

The processing circuit 154 may be disabled in the still image mode because the display data DDT may be generated based on the processed data PDT stored in the frame buffer FB. In addition, the host device doesn't have to transfer image data IMG to the DDIC 105 in the still image mode. As such, the power consumption of the DDIC 105 and the display device including the DDIC 105 may be reduced by disabling the processing circuit 154 and decreasing the amount of data transferred from the host device.

In some embodiments, the interface monitor MON may further generate the mode conversion signal MC indicating mode conversion from the video mode to the still image mode.

In some embodiments, as will be described below with reference to FIG. 10, the interface monitor MON may generate the mode conversion signal MC indicating mode conversion from the video mode to the still image mode when the data frames are not transferred through the host interface during the standby time tSB.

In some embodiments, as will be described below with reference to FIG. 11, the interface monitor MON may receive, from the host device, mode conversion information indicating that a data frame included in image data IMG is a last data frame of the video mode and generate the mode conversion signal MC indicating mode conversion from the video mode to the still image mode based on the mode conversion information.

The first path selector PS1 may be connected to the line buffer 153 through a forth path PTH4, and the second path selector PS2 may be connected to the line buffer 153 through a fifth path PTH5.

The first path selector PA1 may store, through the fourth path PTH4, the data frames included in image data IMG, which is not processed by the processing circuit 154, in the frame buffer FB in the video mode, based on the mode signal MD and the mode conversion signal MC.

The second path selector PS2 may provide, through the fifth path PTH5, the data frame read from the frame buffer FB to the processing circuit 154 when the operating mode is converted from the video mode to the still image mode, based on the mode signal MD and the mode conversion signal MC.

When the operating mode is converted from the video mode to the still image mode will be further described with reference to FIGS. 10 and 11.

The conversion circuit 156 may perform data conversion with respect to the processed data PDT to generate display data DDT to drive the display panel 200. The processing circuit 154 may perform data processing such that the same output is provided with respect to the same input. Alternately, the conversion circuit 156 may perform data conversion such that the different output is provided with respect to the same input by applying modification to the input. In some embodiments, the conversion circuit 156 may perform dithering with respect to the processed data PDT to generate the display data DDT.

The data driver DDRV may drive the display panel 200 to display an image based on the display data DDT. An exemplary configuration and operation of a display device including the data driver DDRV and the display panel 200 will be described hereafter in relation to FIGS. 12 and 13.

With the foregoing configuration, the DDIC 105 of FIG. 9 may efficiently implement the still image mode and the video mode using the interface monitor MON and the path controller 155.

FIGS. 10 and 11 are respective timing diagrams further illustrating operation of the DDIC of FIG. 9.

Referring to FIGS. 9, 10 and 11, the host device may transfer commands CMD and image data IMG to a DDIC. For clarity of description, similar assumptions are made here as were made in relation to the description of the timing diagram of FIG. 3.

The host device may transfer data frames F(i) to the DDIC in synchronization with a vertical synchronization signal Vsync, where i is an integer indicating a frame index. FIGS. 10 and 11 illustrates an example of the data frames F(N−3) ~F(N+4) in synchronization with activation times T1~T3 and T6~T10 transferred from the host device to the DDIC. FIGS. 1-and 11 illustrate also the data frames stored in the frame buffer FB. F(i) indicates the original data frame that is not processed by the processing circuit 154, and PF(i) indicates the processed data frame that is processed by the processing circuit 154.

The interface monitor MON may be connected to the host interface 151, and generate the mode signal MD indicating the still image mode or the video mode by detecting whether image data IMG is transferred through the host interface 151 from the host device. In addition, the interface monitor MON may generate the mode conversion signal MC indicating the mode conversion from the video mode to the still image mode.

FIG. 10 illustrates an embodiment in which the host device does not provide the mode conversion information indicating that a data frame included in the image data is a last data frame of the video mode.

Referring to FIGS. 9 and 10, the still image mode may be performed based on the processed data frame PF(N−1) stored in the frame buffer FB before the time T1.

At the times T1~T5, the data frames F(N)~F(N+4) may be transferred sequentially to the DDIC 105 through the host interface 151 from the host device according to a predetermined frame rate. Here, based on the mode signal MD indicating the video mode, the data frames F(N)~F(N+4) that are not processed by the processing circuit 154 may be stored sequentially in the frame buffer FB through the fourth path PTH4, the first path selector PS1 and the first path PTH1.

As a result, in the video mode, the second path PTH2 may be activated to transfer the processed data frames to the conversion circuit 156 without passing through the frame buffer FB and simultaneously the fourth path PTH4 and the first path PTH1 may be activated to store the last data frame F(N+4) of the video mode that is not processed by the processing circuit 154 in the frame buffer FB. The third path PTH 3 and the fifth path PTH 5 may be deactivated in the video mode.

The interface monitor MON may generate the mode signal MD and the mode conversion signal MC by monitoring whether the data frame is transferred from the host device through the host interface 151 within the standby time tSB.

That is, the interface monitor MON may transition the mode signal MD from the logic low level to the logic high level at the time T7 to convert the operating mode from the video mode to the still image mode if image data IMG is not transferred from the host device within the standby time tSB from the time T6 when the transfer of the last data frame F(N+1) of the video mode is completed. In addition, the interface monitor MON may transition the mode conversion signal MC from the logic low level to the logic high level at the time T7 after the standby time tSB from the time T6.

The second path selector PS2 may transfer or feed-back the last data frame F(N_4) stored in the frame buffer FB to the processing circuit 154 through the fifth path PTH 5 at the time T7 in response to activation of the mode conversion signal MC. The transferred last data frame F(N+4) may be processed by the processing circuit 154 and the last processed data frame PF(N+4) may be over-written in the frame buffer FB. After that, at the times T8~T10, the still image mode may be performed based on the last processed data frame PF(N+4) stored in the frame buffer FB.

FIG. 11 illustrates an example embodiment that the host device provides the mode conversion information LFR indicating that a data frame included in the image data is a last data frame of the video mode.

Referring to FIGS. 9 and 11, the still image mode may be performed based on the processed data frame PF(N−1) stored in the frame buffer FB before the time T1.

At the times T1~T4, the data frames F(N)~F(N+3) may be transferred sequentially to the DDIC 105 through the host interface 151 from the host device according to a predetermined frame rate.

As a result, in the video mode, the second path PTH2 may be activated to transfer the processed data frames to the conversion circuit 156 without passing through the frame buffer FB. The first path PTH1, the third path PTH 3, the fourth path PTH4 and the fifth path PTH 5 may be deactivated in the video mode.

The interface monitor MON may transition the mode signal MD from the logic low level to the logic high level to convert the operating mode from the still image mode to the video mode at the time T5 based on the mode conversion information LFR indicating the last data frame F(N+4) of the video mode. In addition, the interface monitor MON may transition the mode conversion signal MC from the logic low level to the logic high level at the time T5 based on the mode conversion information LFR.

The first path selector PS1 may store the last processed data frame PF(N+4) in the frame buffer FB at the time T5 in response to activation of the mode signal MD and the mode conversion signal MC. That is, the last data frame F(N+4) may be used for the still image mode. After that, at the times T5~T10, the still image mode may be performed based on the last processed data frame PF(N+4) stored in the frame buffer FB.

Figure 12:
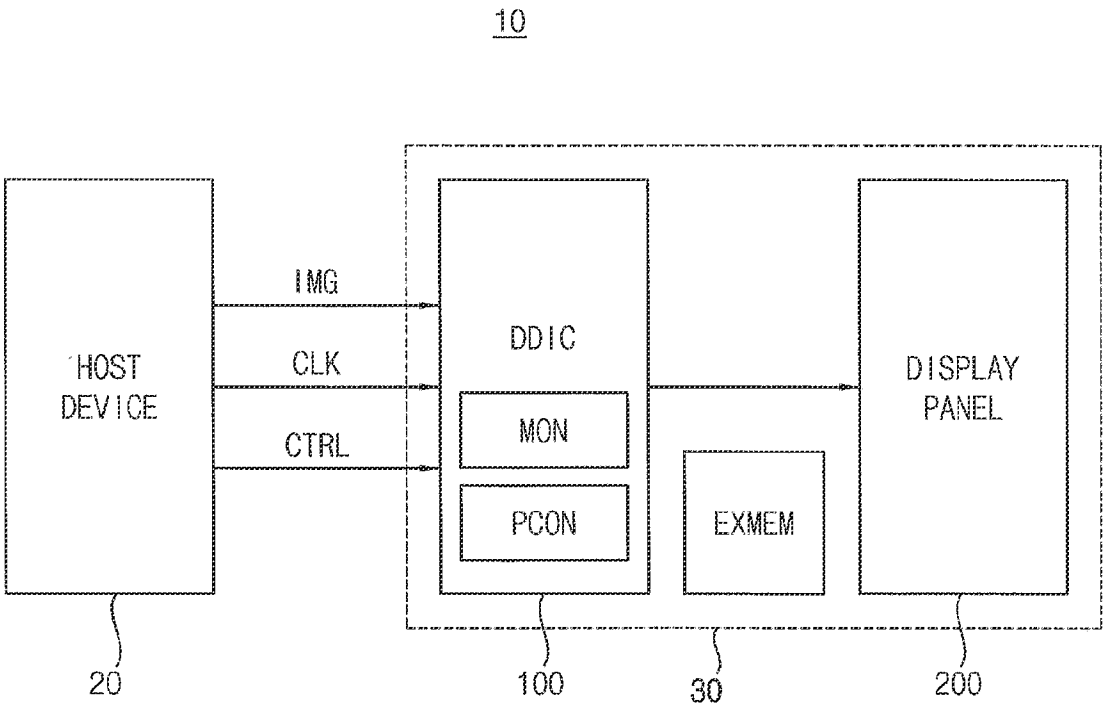
FIG. 12 is a block diagram illustrating a display system according to embodiments of the inventive concept.

FIG. 12 is a block diagram illustrating a display system 10 according to embodiments of the inventive concept.

The display system 10 may one or a variety of electronic devices including a function associated with an image display, such as a mobile phone, a smartphone, a tablet personal computer (PC), a personal digital assistant (PDA), a wearable device, a potable multimedia player (PMP), a handheld device, a handheld computer, etc.

Referring to FIG. 12, the display system 10 may include a host processor 20 and a display device 30. The display device 30 may include a display driving integrated circuit (DDIC) 100, a display panel 200 and an external memory EXMEM outside the DDIC 100.

The host processor 20 may control the overall operation of the display system 10. Here, the host processor 10 may be an application processor (AP), a baseband processor (BBP), a micro-processing unit (MPU), etc. The host processor 20 may provide input image data IMG, a clock signal CLK and control signals CTRL to the display device 30. For example, the input image data IMG may include RGB pixel values and have a resolution of (w*h), where is a number of pixels in a horizontal direction and is a number of pixels in a vertical direction.

The control signals may include a command signal, a horizontal synchronization signal, a vertical synchronization signal, a data enable signal, and so on. For example, the input image data IMG and the control signals CTRL may be provided, as a form of a packet, to the DDIC 100. The command signal may include control information, image information and/or display setting information. The image information may include, for example, a resolution of the input image data IMG. The display setting information may include, for example, panel information, a luminance setting value, and so on. For example, the host processor 20 may provide, as the display setting information, information according to a user input or according to predetermined setting values to the DDIC 100.

The DDIC 100 may drive the display panel 200 based on the input image data IMG and the control signals CTRL. The DDIC 100 may convert the digital input image signal IMG to analog signals, and drive the display panel 200 based on the analog signals.

In some embodiments, the DDIC 100 may include an interface monitor MON and a path controller PCON configured to control the operating mode of the display device 30.

As described above, the interface monitor MON may be connected to the host interface and generate the mode signal MD indicating the still image mode or the video mode by detecting whether image data IMG is transferred through the host interface from the host device 20. The path controller PCON may control the data transfer path based on the mode signal MD. The path controller PCON may store the processed data in the frame buffer and transfer the processed data stored in the frame buffer to the conversion circuit in the still image mode. Alternately, the path controller PCON may transfer the processed data to the conversion circuit without storing the processed data in the frame buffer in the video mode. The frame buffer may be included in the DDIC 100 or in the external memory EXMEM outside the DDIC 100.

FIG. 13 is a block diagram illustrating an electroluminescent display device as an example of the display device 30 of FIG. 12.

Referring to FIG. 13, the display device 30 may include a display panel 200 including pixel rows 211 and a DDIC 100 that drives the display panel 200. The DDIC 100 may include a data driver 130, a scan driver 140, a timing controller 150, a power supply 160, and a gamma circuit 170.

The display panel 200 may be connected to the data driver 130 of the DDIC 100 through data lines and may be connected to the scan driver 140 of the DDIC 100 through scan lines. The display panel 200 may include the pixel rows 211. That is, the display panel 200 may include pixels PX arranged in a matrix of rows and columns. One row of pixels PX connected to the same scan line may be referred to as one pixel row 211. In some embodiments, the display panel 200 may be a self-emitting display panel that emits light without the use of a back light unit. For example, the display panel 200 may be an organic light-emitting diode (OLED) display panel.

Each pixel PX included in the display panel 200 may have various configurations according to a driving scheme of the display device 30. For example, the electroluminescent display device 30 may be driven with an analog or a digital driving method. While the analog driving method produces grayscale using variable voltage levels corresponding to input data, the digital driving method produces grayscale using variable time duration in which the LED emits light. The analog driving method is difficult to implement because the analog driving method uses a driving integrated circuit (IC) that is complicated to manufacture if the display is large and has high resolution. The digital driving method, on the other hand, may readily accomplish high resolution through a simpler IC structure. As the size of the display panel becomes larger and the resolution increases, the digital driving method may have more favorable characteristics over the analog driving method. The method of compensating luminance according to example embodiments may be applied to both of the analog driving method and the digital driving method.

The data driver 130 may apply a data signal to the display panel 200 through the data lines. The scan driver 140 may apply a scan signal to the display panel 200 through the scan lines.

The timing controller 150 may control the operation of the display device 30. The timing controller 150 may provide control signals to the data driver 130 and the scan driver 140 to control the operations of the display device 30. In some embodiments, the data driver 130, the scan driver 140 and the timing controller 150 may be implemented as one integrated circuit (IC). In other example embodiments, the data driver 130, the scan driver 140 and the timing controller 150 may be implemented as two or more integrated circuits. A driving module including at least the timing controller 150 and the data driver 130 may be referred to as a timing controller embedded data driver (TED).

The timing controller 150 may receive the input image data IMG and the input control signals from the host processor 20. For example, the input image data may include red (R) image data, green (G) image data and blue (B) image data. According to example embodiments, the input image data IMG may include white image data, magenta image data, yellow image data, cyan image data, and so on. The input control signals may include a master clock signal, a data enable signal, a horizontal synchronization signal, a vertical synchronization signal, and so on.

The power supply 160 may supply the display panel 200 with a high power supply voltage ELVDD and a low power supply voltage ELVSS. In addition, the power supply 160 may supply a regulator voltage VREG to the gamma circuit 170. The gamma circuit 170 may generate gamma reference voltages GRV based on the regulator voltage VREG.

In some embodiments, the timing controller 150 may include an interface monitor MON and a path controller PCON to control an operating mode of the display device 30.

As described above, the interface monitor MON may be connected to the host interface and generate the mode signal MD indicating the still image mode or the video mode by detecting whether image data IMG is transferred through the host interface from the host device 20. The path controller PCON may control the data transfer path based on the mode signal MD. The path controller PCON may store the processed data in the frame buffer and transfer the processed data stored in the frame buffer to the conversion circuit in the still image mode. Alternately, the path controller PCON may transfer the processed data to the conversion circuit without storing the processed data in the frame buffer in the video mode. The frame buffer may be included in the DDIC 100 or in the external memory outside the DDIC 100.

Figure 14:
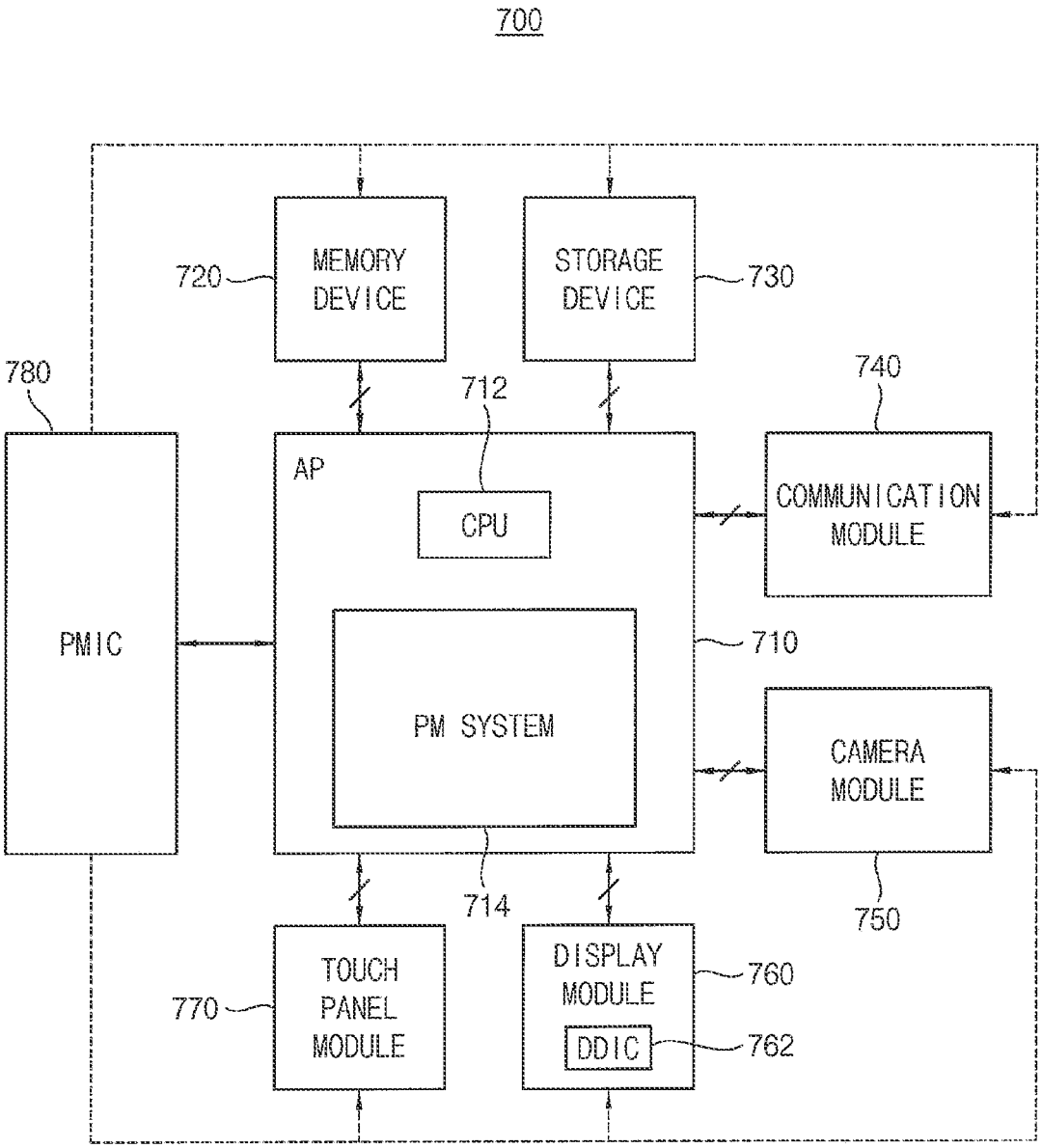
FIG. 14 is a block diagram illustrating a mobile device according to embodiments of the inventive concept.

FIG. 14 is a block diagram illustrating a mobile device 700 according to embodiments of the inventive concept.

Referring to FIG. 14, the mobile device 700 may include a system on chip ("SoC") 710 as well as functional modules 740, 750, 760 and 770. The mobile device 700 may further include a memory device 720, a storage device 730 and a power management device 780.

The SoC 710 controls overall operations of the mobile device 700. In an example embodiment, the SoC 710 controls the memory device 720, the storage device 730 and the plurality of functional modules 740, 750, 760 and 770, for example. The SoC 710 may be an application processor ("AP") that is included in the mobile device 700.

The SoC 710 may include a CPU 712 and a power management system PM SYSTEM 714. The memory device 720 and the storage device 730 may store data for operations of the mobile device 700. In an exemplary embodiment, the memory device 720 may include a volatile memory device, such as a dynamic random access memory ("DRAM"), a static random access memory ("SRAM"), a mobile DRAM, etc. In an exemplary embodiment, the storage device 730 may include a nonvolatile memory device, such as an erasable programmable read-only memory ("EPROM"), an electrically EPROM ("EEPROM"), a flash memory, a phase change random access memory ("PRAM"), a resistance random access memory ("RRAM"), a nano floating gate memory ("NFGM"), a polymer random access memory ("PoRAM"), a magnetic random access memory ("MRAM"), a ferroelectric random access memory ("FRAM"), etc. In exemplary embodiments, the storage device 730 may further include a solid state drive ("SSD"), a hard disk drive ("HDD"), a CD-ROM, etc.

The functional modules 740, 750, 760 and 770 perform various functions of the mobile device 700. In an exemplary embodiment, the mobile device 700 may include a communication module 740 that performs a communication function (e.g., a code division multiple access ("CDMA") module, a long term evolution ("LTE") module, a radio frequency (RF) module, an ultra-wideband ("UWB") module, a wireless local area network (WLAN) module, a worldwide interoperability for a microwave access ("WIMAX") module, etc.), a camera module 750 that performs a camera function, a display module 760 that performs a display function, a touch panel module 770 that performs a touch sensing function, etc., for example. In exemplary embodiments, the mobile device 700 may further include a global positioning system ("GPS") module, a microphone ("MIC") module, a speaker module, a gyroscope module, etc., for example. However, the functional modules 740, 750, 760, and 770 in the mobile device 700 are not limited thereto.

The power management device 780 may provide an operating voltage to the SoC 710, the memory device 720, the storage device 730 and the functional modules 740, 750, 760 and 770.

In some embodiments, the display module 760 may include a DDIC 762 and the DDIC 762 may include an interface monitor MON and a path controller PCON to control an operating mode of the display device 30.

As described above, the interface monitor MON may be connected to the host interface and generate the mode signal MD indicating the still image mode or the video mode by detecting whether image data IMG is transferred through the host interface from the host device. The path controller PCON may control the data transfer path based on the mode signal MD. The path controller PCON may store the processed data in the frame buffer and transfer the processed data stored in the frame buffer to the conversion circuit in the still image mode. Alternately, the path controller PCON may transfer the processed data to the conversion circuit without storing the processed data in the frame buffer in the video mode.

Figure 15:
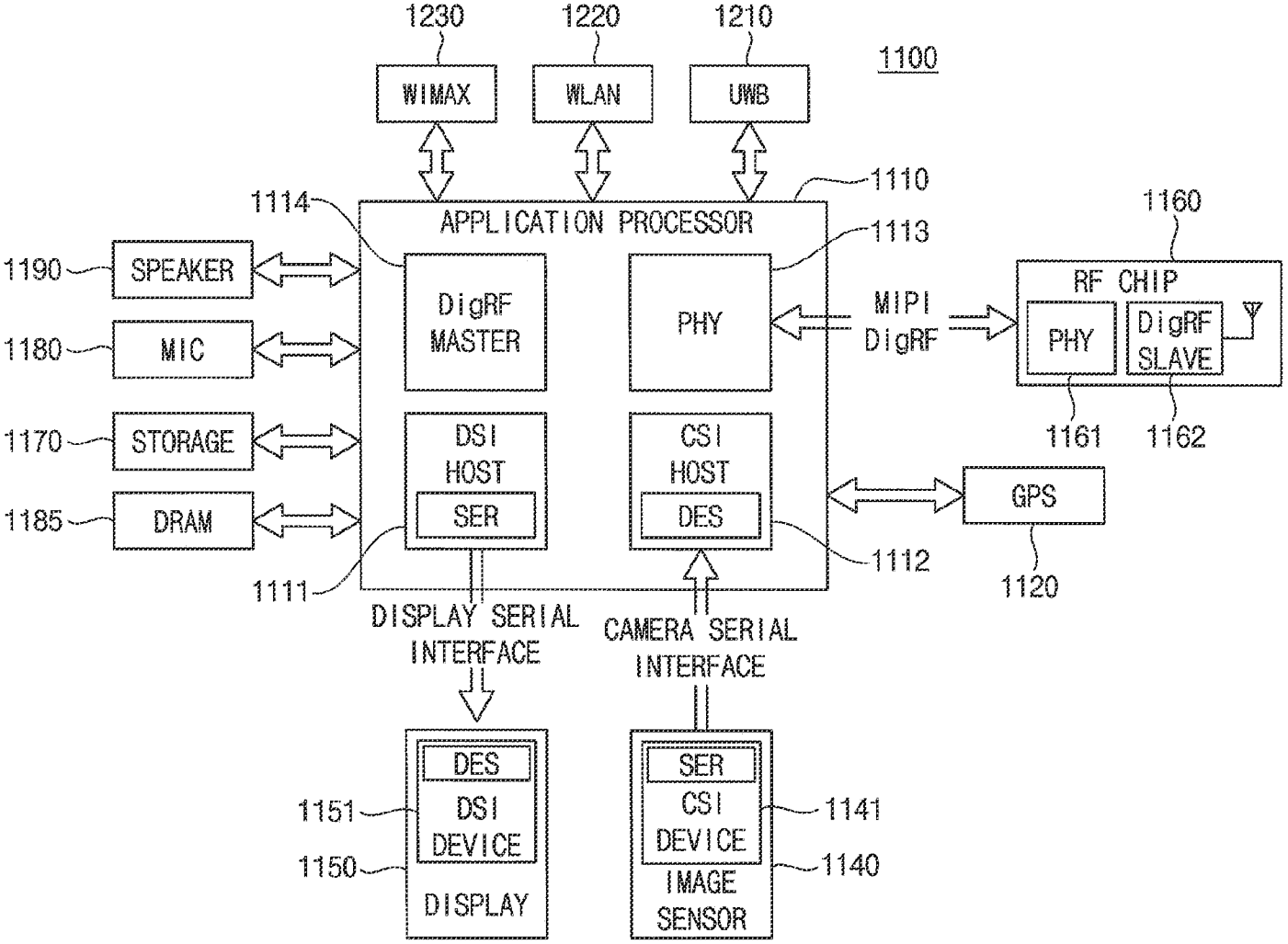
FIG. 15 is a block diagram illustrating interface(s) that may be used in relation to the mobile device of FIG. 14.

FIG. 15 is a block diagram illustrating a variety of interfaces that may be used in relation to the mobile device of FIG. 14.

Referring to FIG. 15, a computing system 1100 may employ or support a MIPI interface, and may include an application processor 1110, a ToF sensor 1140 and a display device 1150. A CSI host 1112 of the application processor 1110 may perform a serial communication with a CSI device 1141 of the ToF sensor 1140 using a camera serial interface (CSI). In some embodiments, the CSI host 1112 may include a deserializer DES, and the CSI device 1141 may include a serializer SER. A DSI host 1111 of the application processor 1110 may perform a serial communication with a DSI device 1151 of the display device 1150 using a display serial interface (DSI). In some embodiments, the DSI host 1111 may include a serializer SER, and the DSI device 1151 may include a deserializer DES.

The computing system 1100 may further include a radio frequency (RF) chip 1160, which may include a physical layer PHY 1161 and a DigRF slave 1162. A physical layer PHY 1113 of the application processor 1110 may perform data transfer with the physical layer PHY 1161 of the RF chip 1160 using a MIPI DigRF. The PHY 1113 of the application processor 1110 may interface (or alternatively communicate) a DigRF MASTER 1114 for controlling the data transfer with the PHY 1161 of the RF chip 1160.

The computing system 1100 may further include a global positioning system (GPS) 1120, a storage device 1170, a microphone 1180, a DRAM 1185 and/or a speaker 1190. The computing system 1100 may communicate with external devices using an ultra-wideband (UWB) communication interface 1210, a wireless local area network (WLAN) communication interface 1220, a worldwide interoperability for microwave access (WIMAX) communication interface 1230, or the like. However, embodiments of the inventive concept are not limited to only the configuration or interface(s) shown in FIG. 15.

In some embodiments, the display device 1150 may include the interface monitor MON and the path controller PCON. As described above, the interface monitor MON may be connected to the host interface and generate the mode signal MD indicating the still image mode or the video mode by detecting whether image data IMG is transferred through the host interface from the host device. The path controller PCON may control the data transfer path based on the mode signal MD. The path controller PCON may store the processed data in the frame buffer and transfer the processed data stored in the frame buffer to the conversion circuit in the still image mode. Alternately, the path controller PCON may transfer the processed data to the conversion circuit without storing the processed data in the frame buffer in the video mode.

As described above, the DDIC according to example embodiments may efficiently implement the still image mode and the video mode using the interface monitor and the path controller. In addition, the DDIC and the display device according to example embodiments may reduce the size and the power consumption of the DDIC by appropriately disposing the frame buffer and the compensation memory and disabling a portion of the components included in the DDIC depending on the operating mode.

Various embodiments of the inventive concept may be applied to any electronic devices and systems. For example, the inventive concept may be applied to systems such as a mobile phone, a smart phone, a personal digital assistant (PDA), a portable multimedia player (PMP), a digital camera, a camcorder, a personal computer (PC), a server computer, a workstation, a laptop computer, a digital TV, a set-top box, a portable game console, a navigation system, a wearable device, an internet of things (IoT) device, an internet of everything (IoE) device, an e-book, a virtual reality (VR) device, an augmented reality (AR) device, a vehicle navigation system, a video phone, a monitoring system, an auto focusing system, a tracking system, a motion detecting system, etc.

The foregoing description is intended is be illustrative in nature in order to teach the making and use of the inventive concept. Although a few embodiments have been particularly illustrated and described, those skilled in the art will readily appreciate that many modifications are possible without materially departing from the scope of the inventive concept.

What is claimed is:

1. A display driving integrated circuit (DDIC) comprising:

a host interface configured to receive image data from a host device;

an interface monitor configured to generate a mode signal indicating:

a video mode in response to detecting a transfer of image data from the host device through the host interface, and a still image mode in response to detecting an absence of the image data from the host device through the host interface for more than a predetermined non-zero time;

a processing circuit configured to generate processed data by processing the image data;

a conversion circuit configured to perform data conversion on the processed data to generate display data driving a display panel; and a path controller configured to:

store the processed data in a frame buffer and transfer the processed data stored in the frame buffer to the conversion circuit in response to the mode signal indicating the still image mode, and transfer the processed data to the conversion circuit without storing the processed data in the frame buffer in response to the mode signal indicating the video mode.

2. The DDIC of claim 1, further comprising:

an encoder disposed between the processing circuit and the frame buffer and configured to compress the processed data to generate compressed data and store the compressed data in the frame buffer; and a decoder disposed between the frame buffer and the conversion circuit and configured to decompress the compressed data from the frame buffer to again generate the processed data and transfer the processed data to the conversion circuit.

3. The DDIC of claim 1, wherein the path controller includes:

a first path selector configured in response to the mode signal to:

provide the processed data to a first path connected to the frame buffer in response to the mode signal indicating the still image mode, and provide the processed data to a second path not connected to the frame buffer in response to the mode signal indicating the video mode; and a second path selector configured to:

provide the processed data to the conversion circuit through a third path connected to the frame buffer in response to the mode signal indicating the still image mode, and provide the processed data to the conversion circuit through the second path in response to the mode signal indicating the video mode.

4. The DDIC of claim 1, wherein the processing circuit is disabled in response to the mode signal indicating the still image mode.

5. The DDIC of claim 1, wherein the path controller stores data frames included in the image data in the frame buffer in response to the mode signal indicating the video mode.

6. The DDIC of claim 5, wherein the interface monitor is further configured to generate a mode conversion signal indicating mode conversion from the video mode to the still image mode in response to detecting the absence of the image data from the host device through the host interface for more than the predetermined non-zero time.

7. The DDIC of claim 6, wherein the path controller is further configured to:

transfer a last data frame stored most recently in the frame buffer to the processing circuit, and store in the frame buffer a last processed data frame generated by processing the last data frame using the processing circuit.

8. The DDIC of claim 1, wherein the interface monitor is further configured to:

receive mode conversion information from the host device, wherein the mode conversion information indicates that a data frame included in the image data is a last data frame of the video mode, and generate a mode conversion signal indicating mode conversion from the video mode to the still image mode in response to the mode conversion information.

9. The DDIC of claim 8, wherein the path controller is further configured to store in the frame buffer a last processed data frame generated by processing the last data frame by the processing circuit.

10. The DDIC of claim 1, wherein the conversion circuit is further configured to perform dithering with respect to the processed data to generate the display data.

11. The DDIC of claim 1, further comprising a line buffer disposed between the host interface and the processing circuit and configured to:

generate buffered image data by buffering the image data, and provide the buffered image data by units of line.

12. The DDIC of claim 1, wherein the host interface, the interface monitor, the processing circuit, the conversion circuit, and the path controller of the DDIC are collectively implemented in a single semiconductor chip.

13. The DDIC of claim 12, wherein the frame buffer is implemented in the single semiconductor chip.

14. The DDIC of claim 12, further comprising:

a memory interface implemented in the single semiconductor chip, wherein the memory interface is connected to the path controller, such that the processed data is transferred through the memory interface between the DDIC and the frame buffer disposed external to the single semiconductor chip.

15. The DDIC of claim 12, further comprising:

a memory interface implemented in the single semiconductor chip, wherein the memory interface is connected to the processing circuit, such that intermediate data generated by the processing circuit is transferred through the memory interface between the DDIC and an external memory disposed external to the single semiconductor chip.

16. A method of operating a display driving integrated circuit (DDIC), the method comprising:

generating a mode signal indicating:

a video mode in response to detecting a transfer of image data from a host device through a host interface, and a still image mode in response to detecting an absence of the image data from the host device through the host interface for more than a predetermined non-zero time;

processing the image date to generate processed data using a processing circuit;

in response to the mode signal indicating the still image mode, storing the processed data in a frame buffer and generating display data to drive a display panel in response to the processed data stored in the frame buffer; and in response to the mode signal indicating the video mode, generating the display data in response to the processed data provided from the processing circuit without storing the processed data in the frame buffer.

17. The method of claim 16, further comprising:

compressing the processed data to generate compressed data;

storing the compressed data in the frame buffer;

decompressing the compressed data from the frame buffer to again provide the processed data; and then, transferring the processed data to a conversion circuit.

18. The method of claim 16, further comprising:

in response to the mode signal indicating the video mode, storing data frames included in the image data in the frame buffer;

generating a last processed data frame by processing a last data frame stored most recently in the frame buffer to store the last processed data frame in the frame buffer; and generating the mode signal indicating the still image mode in response to the last processed data frame stored in the frame buffer.

19. A display device comprising:

a display panel; and a display driving integrated circuit (DDIC) configured to drive the display panel, wherein the DDIC comprises:

a host interface configured to receive image data from a host device;

an interface monitor configured to generate a mode signal indicating:

a video mode in response to detecting a transfer of image data from the host device through the host interface, and a still image mode in response to detecting an absence of the image data from the host device through the host interface for more than a predetermined non-zero time;

a processing circuit configured to generate processed data by processing the image data;

a conversion circuit configured to perform data conversion on the processed data to generate display data driving a display panel; and a path controller configured to:

store the processed data in a frame buffer and transfer the processed data stored in the frame buffer to the conversion circuit in response to the mode signal indicating the still image mode, and transfer the processed data to the conversion circuit without storing the processed data in the frame buffer in response to the mode signal indicating the video mode.

* * * * *